US012590356B2

(12) United States Patent
Richard et al.

(10) Patent No.: US 12,590,356 B2
(45) Date of Patent: Mar. 31, 2026

(54) SUPERALLOY POWDER, PART AND METHOD FOR MANUFACTURING THE PART FROM THE POWDER

(71) Applicant: SAFRAN, Paris (FR)

(72) Inventors: Sébastien Jean Richard, Moissy-Cramayel (FR); Jérémy Rame, Moissy-Cramayel (FR)

(73) Assignee: SAFRAN, Paris (FR)

( * ) Notice: Subject to any disclaimer, the term of this patent is extended or adjusted under 35 U.S.C. 154(b) by 783 days.

(21) Appl. No.: 17/597,060

(22) PCT Filed: Jun. 18, 2020

(86) PCT No.: PCT/FR2020/051062
§ 371 (c)(1),
(2) Date: Dec. 23, 2021

(87) PCT Pub. No.: WO2020/260806
PCT Pub. Date: Dec. 30, 2020

(65) Prior Publication Data

US 2022/0243305 A1 Aug. 4, 2022

(30) Foreign Application Priority Data

Jun. 28, 2019 (FR) ..... 1907198

(51) Int. Cl.
*C22C 19/05* (2006.01)
*B22F 1/052* (2022.01)
(Continued)

(52) U.S. Cl.
CPC ..... *C22C 19/056* (2013.01); *B22F 1/052* (2022.01); *B22F 1/065* (2022.01); *B22F 3/225* (2013.01); *C22C 1/0433* (2013.01); *B22F 2003/248* (2013.01); *B22F 2301/15* (2013.01)

(58) Field of Classification Search
CPC .. C22C 19/056; B22F 3/225; B22F 2003/248; B22F 2301/15
(Continued)

(56) References Cited

U.S. PATENT DOCUMENTS 7,387,763 B2 * 6/2008 Kelly ..... C22C 21/00 419/48
2006/0039817 A1 2/2006 Kelly
(Continued)

FOREIGN PATENT DOCUMENTS

CN 101935781 A 1/2011
CN 109385589 A 2/2019
(Continued)

OTHER PUBLICATIONS

French Search Report issued in French Application FR1907198 on Mach 30, 2020 (2 pages).
(Continued)

*Primary Examiner* — Sally A Merkling
*Assistant Examiner* — Nazmun Nahar Shams
(74) *Attorney, Agent, or Firm* — Bookoff McAndrews, PLLC

(57) ABSTRACT

A nickel-based superalloy powder comprising, by mass percent, 14.00 to 15.25% chromium, 14.25 to 15.75% cobalt, 3.9 to 4.5% molybdenum, 4.0 to 4.6% aluminum, 3.0 to 3.7% titanium, 0 to 200 ppm carbon, the remainder consisting of nickel and unavoidable impurities. Component made from the powder and manufacturing process of the component.

3 Claims, 5 Drawing Sheets

(51) Int. Cl.

| | |
|---|---|
| ***B22F 1/065*** | (2022.01) |
| ***B22F 3/22*** | (2006.01) |
| ***B22F 3/24*** | (2006.01) |
| ***C22C 1/04*** | (2023.01) |

(58) Field of Classification Search
USPC ..... 419/29
See application file for complete search history.

(56) References Cited

U.S. PATENT DOCUMENTS

| | | | | |
|---|---|---|---|---|
| 2007/0051199 | A1* | 3/2007 | Etuve | C22C 19/058 75/255 |
| 2019/0055627 | A1* | 2/2019 | Nagatomi | C22C 19/055 |
| 2020/0230695 | A1* | 7/2020 | Protzmann | B23K 15/0086 |

FOREIGN PATENT DOCUMENTS

| | | | |
|---|---|---|---|
| CN | 110241331 | A | 9/2019 |
| EP | 0421229 | A1 | 4/1991 |
| EP | 1195446 | A1 | 4/2002 |
| EP | 1878533 | A2 | 1/2008 |
| EP | 3336210 | A1 | 6/2018 |
| FR | 2944720 | A1 | 10/2010 |
| JP | S5620345 | B | 5/1981 |
| JP | H0176007 | A | 7/1989 |
| JP | 2002523630 | A | 7/2002 |
| WO | 2018216067 | A1 | 11/2018 |
| WO | 2018220213 | A1 | 12/2018 |

OTHER PUBLICATIONS

International Search Report issued in International Application PCT/FR2020/051062 on Dec. 4, 2020 with English Translation (5 pages).
Office Action in Chinese Application No. 202080045399.9 on Dec. 5, 2022 (10 pages).
Notice of Refusal issued in corresponding application JP 2021577660, mailed Aug. 6, 2024.

* cited by examiner

[Fig. 1]
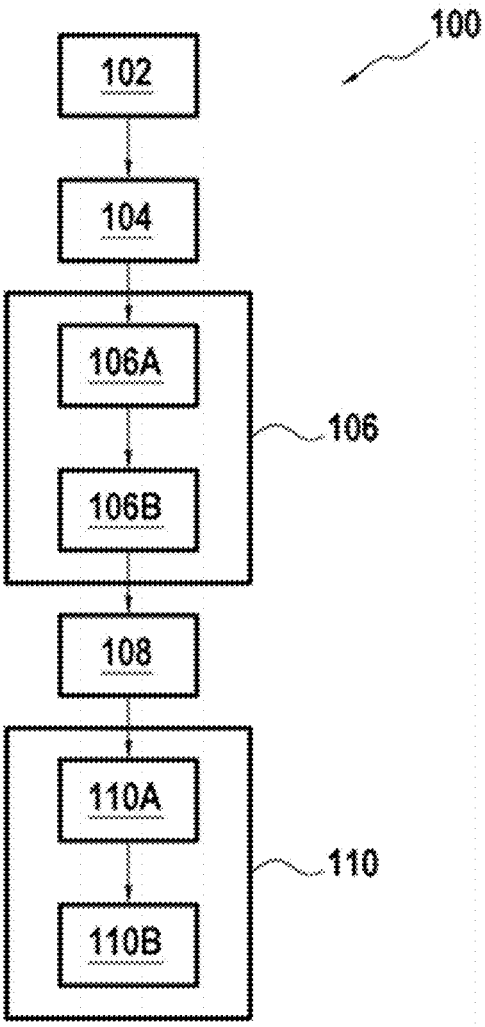

[Fig 2A]
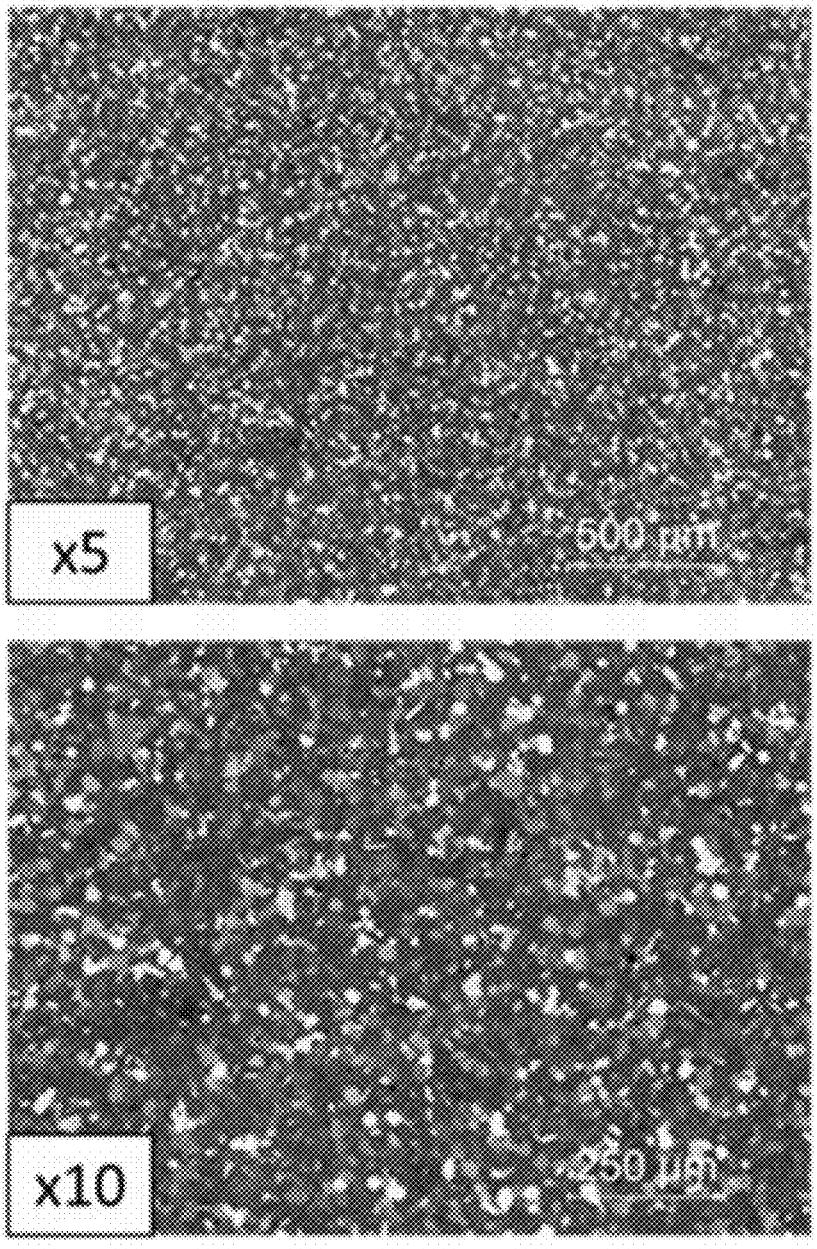

[Fig. 2B]
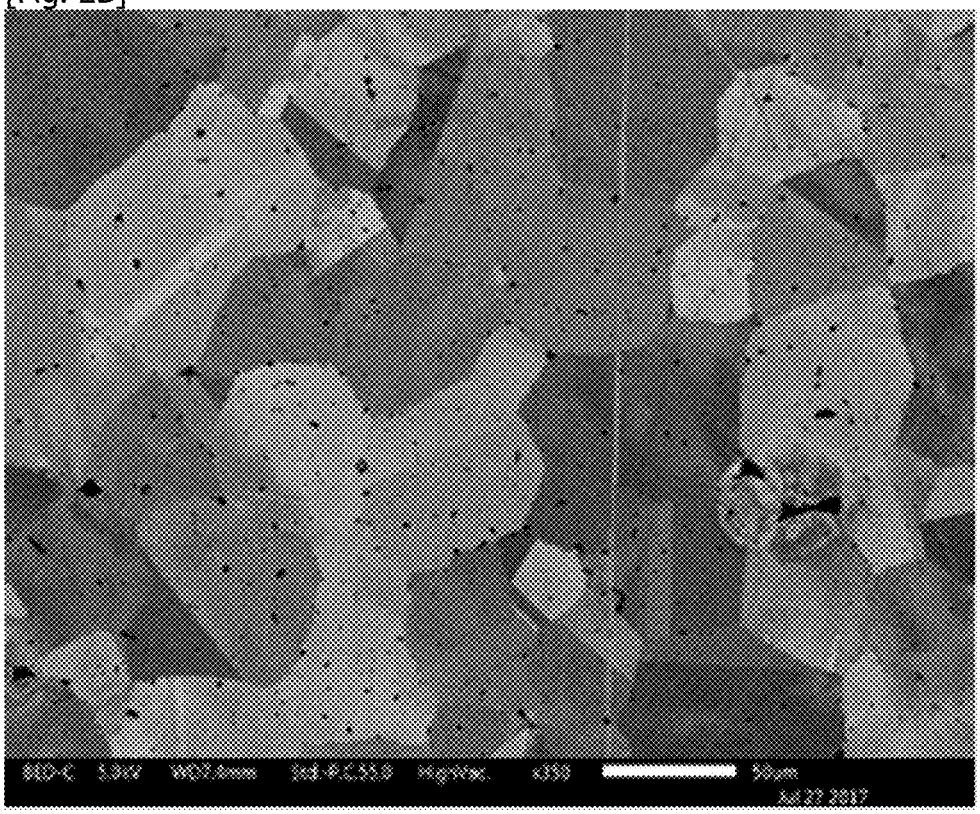

[Fig. 3A]
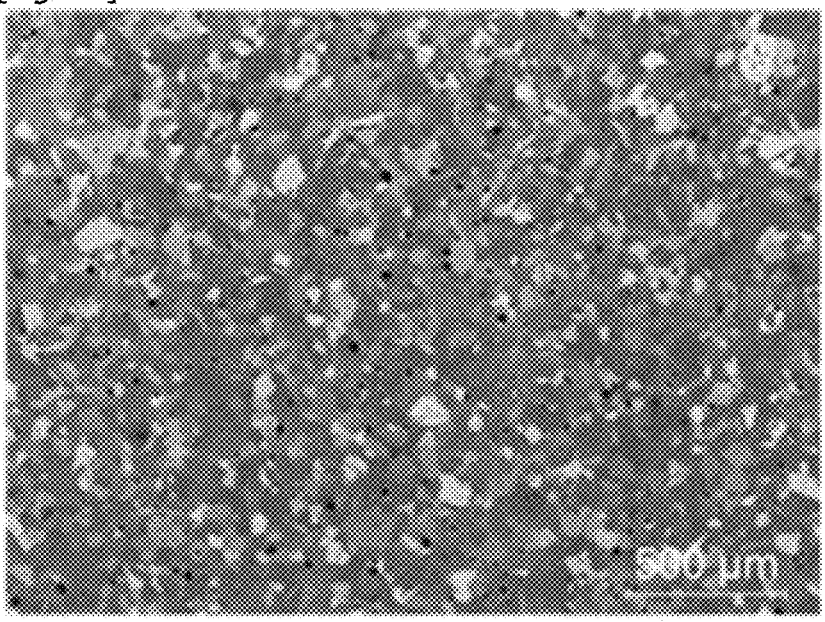
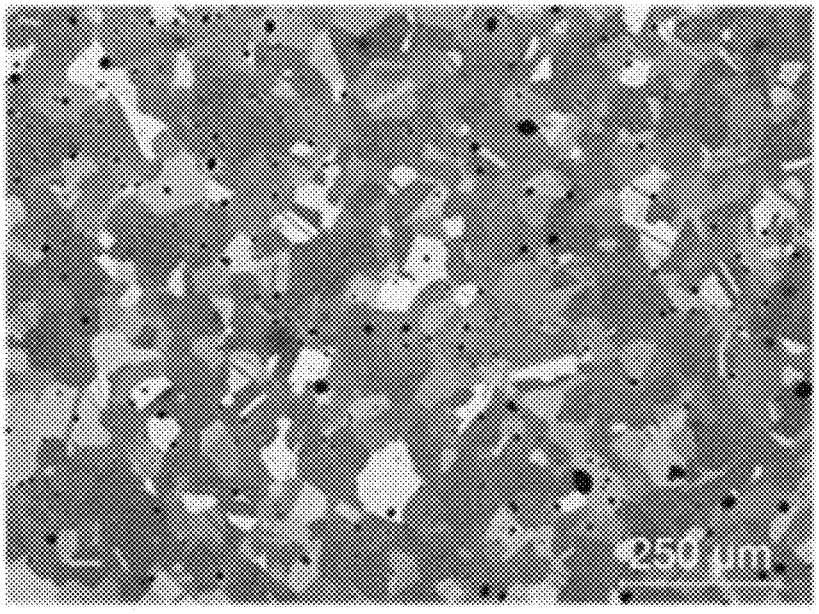

[Fig. 3B]
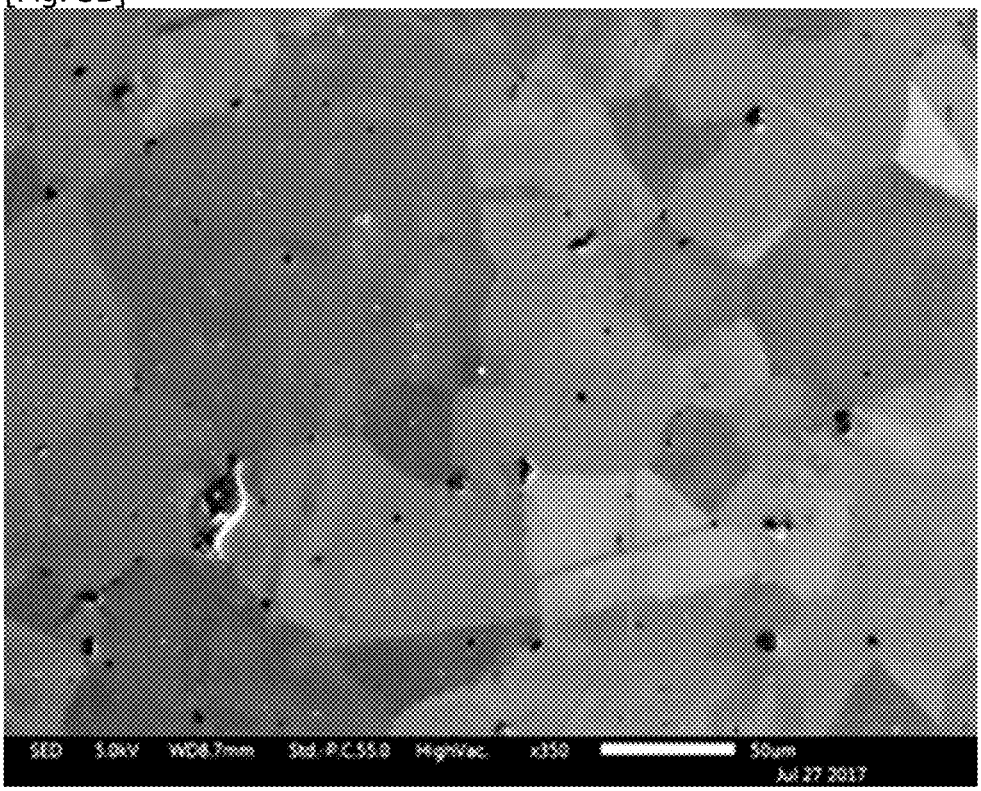

SUPERALLOY POWDER, PART AND METHOD FOR MANUFACTURING THE PART FROM THE POWDER

CROSS-REFERENCE TO RELATED APPLICATION(S)

This patent application is the U.S. National Stage entry under 35 U.S.C. § 371 of International Patent Application No. PCT/FR2020/051062, filed on Jun. 18, 2020, which claims the benefit of priority to French Patent Application No. 1907198, filed on Jun. 28, 2019.

TECHNICAL FIELD

The present disclosure relates to a superalloy powder, a component made from the powder and a process for manufacturing the component from the powder.

PRIOR ART

The process for manufacturing a metal component by powder injection, called metal injection molding (MIM), comprises a step of mixing the metal powder with plastic binders to allow the mixture to be injected into a mold. The raw component obtained in the injection mold s then debonded and sintered to obtain a dense component. When the alloy is a nickel-based superalloy, the dense component is then heat treated to obtain the desired properties.

However, in a MIM manufacturing process of a René 77 alloy, it is difficult to obtain a component with good creep behavior, in particular at temperatures above 800 degrees Celsius (° C.).

This high-temperature creep behavior can have a negative impact on René 77 components produced by MIM. This creep behavior may limit the field of application of René 77 components produced by the MIM process.

DISCLOSURE OF THE INVENTION

The present disclosure aims to remedy, at least partly, some of these disadvantages.

To this end, the present disclosure relates to a nickel-based superalloy powder comprising, by mass percent, 14.00 to 15.25% chromium, 14.25 to 15.75% cobalt, 3.9 to 4.5% molybdenum, 4.0 to 4.6% aluminum, 3.0 to 3.7% titanium, 0 to 0.10 copper, 0 to 0.50 iron, 0 to 200 ppm carbon, the remainder consisting of nickel and unavoidable impurities.

This powder is intended for the manufacture of nickel-based superalloy components, such as vanes or blades, for example gas turbine vanes.

The major additive elements are cobalt (Co), chromium (Cr), molybdenum (Mo), aluminum (AI) and titanium (Ti).

The minor additive elements are copper (Cu) and iron (Fe), for which the maximum mass percentage is less than 1%.

Unavoidable impurities are defined as those elements which are not intentionally added to the composition and which are provided with other elements. Among unavoidable impurities, mention may be made of silicon (Si), manganese (Mn), oxygen (O), sulfur (S), boron (B) and yttrium (Y).

It will be noted that although the carbon content of a nickel-based superalloy may be given an upper limit, nickel-based superalloys generally have a carbon content close to this upper limit. It is therefore understood that a superalloy comprising less than 500 ppm carbon generally has a carbon content close to 500 ppm and the carbon content is generally greater than 300 ppm.

By virtue of the carbon content of the powder, which is less than or equal to 200 ppm (parts per million by mass), it is possible to limit the carbon content of the green component and of the debonded component. As the carbon content of the debinding component is reduced during the sintering step, carbide precipitation at the grain boundaries may be greatly reduce compared with a conventional powder with a similar composition, in which the carbon content is generally greater than 500 ppm or even 700 ppm.

Indeed, the inventors have identified that one of the sources that limits the creep properties of the component is the presence of carbides at the grain boundaries which slows or even prevents the growth of the grains of the sintered component.

Thus, during the heat treatment step to grow the grains in the sintered component, it is possible to obtain grains with a size greater than that which may be obtained with a conventional powder in which the carbon content is generally greater than 500 ppm or even 700 ppm.

As the grain size is larger than the size that may be obtained with a conventional powder in which the carbon content is generally greater than 500 ppm or even 700 ppm, the creep behavior of the component is improved.

In some embodiments, the superalloy powder comprises 5 to 200 ppm carbon.

In some embodiments, the superalloy powder has a D90 particle size of less than or equal to 75 μm, preferably less than or equal to 50 μm, measured by laser diffraction according to the ISO 13320 standard.

The smaller the particle size of the powder, the lower the sintering temperature and the higher the density of the sintered component.

In some embodiments, the superalloy powder has a spherical morphology.

The spherical morphology is advantageous for the MIM process and for sintering.

The present disclosure also relates to a component made from the nickel-based superalloy powder as defined above, the component comprising less than 700 ppm carbon, preferably less than 600 ppm carbon In some embodiments, the component is obtained by a powder injection molding process.

In some embodiments, the average grain size is greater than or equal to ASTM6, preferably greater than or equal to ASTMS, more preferably greater than or equal to ASTM 4, as measured according to the ASTM E112-13 standard.

The present disclosure also relates to a manufacturing process of a component from a nickel-based superalloy powder as defined above, comprising the following steps:

- mixing the nickel-based superalloy powder with at least two binders to obtain a mixture;
- injection molding the mixture in a mold to obtain a green component;
- debinding the green component to obtain a debonded component;
- sintering the debonded component to obtain a sintered component; and
- heat treating the sintered component comprising a step of growing the grains so that the average grain size is greater than or equal to ASTM6, preferably greater than or equal to ASTMS, even more preferably greater than or equal to ASTM4, measured according to the ASTM E112-13 standard and a step of precipitating a γ' phase.

In some embodiments, the sintering step is performed with a temperature step comprised between 1 h and 6 h.

In some embodiments, the grain growth step is carried out with a temperature step greater than or equal to 1 h and less than or equal to 20 h, preferably less than or equal to 15 h, even more preferably less than or equal to 10 h.

In some embodiments, the step of precipitating a γ' phase is carried out with a temperature step greater than or equal to 1 h and less than or equal to 20 h, preferably less than or equal to 15 h, more preferably less than or equal to 10 h.

In some embodiments, the loading ratio of the mixture is greater than or equal to 55%, preferably greater than or equal to 60% and less than or equal to 75%, preferably less than or equal to 70%.

The loading ratio of the mixture is defined as the ratio of the volume of powder to the total volume (powder+additives). Additives comprise binders and may comprise other additives.

In some embodiments, the debinding step is performed in two substeps, a first substep of debinding the primary binder and a second substep of debinding the secondary binder.

The second debinding substep is a thermal step, i.e., a step in which the component is heated to burn off the secondary binder and obtain the debound component.

BRIEF DESCRIPTION OF THE DRAWINGS

Other features and advantages of the present disclosure will emerge from the following description of embodiments, given by way of non-limiting examples, with reference to the appended figures.

FIG. 1 is a flowchart showing the steps of a process for manufacturing a component from a nickel-based superalloy powder of the present disclosure.

FIG. 2A is a micrograph of a component obtained by the process of FIG. 1 from a superalloy powder comprising more than 200 ppm carbon, after the sintering step.

FIG. 2B is a micrograph of the component of FIG. 2A after a grain growth step.

FIG. 3A is a micrograph of a component obtained by the process of FIG. 1 from a superalloy powder comprising less than 200 ppm carbon.

FIG. 3B is a micrograph of the component of FIG. 3A after a grain growth step.

DETAILED DESCRIPTION

FIG. 1 schematically shows a process for manufacturing 100 a component from a nickel-based superalloy powder comprising between 0 and 200 ppm carbon, preferably between 5 and 200 ppm carbon.

EXAMPLES

Two superalloy powder compositions were studied, a composition comprising 160 ppm carbon (Example 1) and a composition similar to the composition of Example 1 but comprising 740 ppm carbon (Example 2).

The respective compositions of Examples 1 and 2 (Ex1 and Ex2) are given in Table 1 in mass percent, the remainder consisting of nickel and unavoidable impurities.

Example 1 further comprises, as unavoidable impurities, 0.060% by mass silicon and 0.030% by mass oxygen.

Example 2 further comprises, as unavoidable impurities, 0.050% by mass silicon, 0.022% by mass oxygen and 0.014% by mass manganese.

TABLE 1

| | Cr | Co | Mo | Al | Ti | Cu | Fe | C |
|---|---|---|---|---|---|---|---|---|
| Ex1 | 14.72 | 15.06 | 4.3 | 4.4 | 3.6 | 0.03 | 0.20 | 0.0160 |
| Ex2 | 15.01 | 14.30 | 4.5 | 4.2 | 3.5 | 0.03 | 0.14 | 0.0740 |

During the mixing step 102, the superalloy powder is mixed with at least two binders, a thermoplastic primary binder which gives the mixture rheological properties allowing the mixture to be injected into the mold and a secondary binder which gives the green component a mechanical strength allowing the green component to be handled after demolding.

Typically, the loading ratio of the mixture, i.e., the volume of powder in relation to the total volume (powder+additives) is comprised between 60 and 70%. The additives comprise binders and other additives.

In the embodiment described, the ratio of primary binder to secondary binder is 2:1 by mass, i.e., the mixture comprises twice as much primary binder as secondary binder by mass.

As non-limiting examples of thermoplastic primary binders, mention may be made of paraffin, carnauba wax, beeswax, peanut oil, acetanilide, antipyrine, naphthalene, polyoxymethylene resin (POM).

As non-limiting examples of secondary binders, mention may be made of polyethylene (PE), polypropylene (PP), polystyrene (PS), polyamides (PA), polyethylene vinyl acetate (PE-VA), polyethyl acrylate (PEA), polyphthalamides (PPA).

As non-limiting examples of other additives, mention may be made of stearic acid, oleic acid and esters thereof, and phthalic acid esters.

The step of injection molding 104 the mixture in a mold to obtain a green component is then performed in a known manner.

The debinding step 106 is generally performed in two substeps, a first substep 106A of debinding the primary binder. This step of debinding the primary binder 106A is generally performed at a temperature comprised between 30° C. and 100° C. and by means of a solvent. The solvent may, for example, be water.

The secondary binder is always present and gives the component a mechanical strength that allows it to be handled.

The second debinding substep 106B is a thermal step, i.e., a step in which the component is heated to burn off the secondary binder and obtain the debonded component.

This second substep 106B is, for example, performed during the temperature rise for sintering of the component. For example, the thermal debinding step 106B is performed between 400° C. and 700° C. with a step comprised between 30 minutes and 10 hours.

In the sintering step 108, the debonded components densified. For example, the component is sintered at 1230° C. to 1300° C. for 5 h.

FIGS. 2 and 3 show the microstructures of Example 2 and Example 1, respectively. It may be seen that after the sintering step 108 and before the heat treatment step 110, the average grain size is about ASTM8 for Example 2 while its about ASTM4 for Example 1, measured according to the ASTM E112-13 standard.

The sintered components then heat treated. The heat treatment step 110 comprises a step of growing grains 110A such that the average grain sizes greater than or equal to ASTM6, preferably greater than or equal to ASTMS, more preferably greater than or equal to ASTM4, measured according to the ASTM E112-13 standard and a step of precipitating a γ' phase 110B.

Typically, after the grain growth step 110A, for Example 2, the average grain size is about ASTM6 for a grain growth step 110A performed at 1275° C. for 10 h.

After the grain growth step 110A, for Example 1, the average grain size is about ASTM3 for a grain growth step 110A performed at 1275° C. for 5 h.

After the grain growth step 110A, the heat treatment step 110 comprises the step of precipitating a γ' phase 110B. This step of precipitating a γ' phase 110B does not change the average grain size.

Between the sintering step 108 and the heat treatment step 110, the component may be brought down to room temperature.

Between the grain growth step 110A and the precipitation step 110B, the component may be brought down to room temperature.

The component obtained from the superalloy powder of Example 1 has better high-temperature creep behavior than the component obtained from the superalloy powder of Example 2. By way of indication, at 950° C., all test conditions being constant, a service life between 2 to 2.5 times longer is observed for the component obtained from the superalloy powder of Example 1 than for the component obtained from the superalloy powder of Example 2. The tests a uniaxial tensile creep test, conducted to failure, according to the NF EN ISO 204 standard.

Although the present disclosure has been described with reference to a specific example embodiment, its obvious that various modifications and changes may be made to these examples without departing from the general scope of the invention as defined by the claims. Furthermore, individual features of the various embodiments discussed may be combined in additional embodiments. Consequently, the description and drawings should be considered in an illustrative rather than a restrictive sense.

The invention claimed is:

1. A nickel-based superalloy powder consisting of, by mass percent, 14.00 to 15.25% chromium, 14.25 to 15.75% cobalt, 3.9 to 4.5% molybdenum, 4.0 to 4.6% aluminum, 3.0 to 3.7% titanium, 0 to 0.10 copper, 0 to 0.50 iron, 5 to 200 ppm carbon, and a remainder consisting of nickel and unavoidable impurities.

2. The nickel-based superalloy powder according to claim 1, having a D90 particle size of less than or equal to 75 μm measured by laser diffraction according to an ISO 13320 standard.

3. The nickel-based superalloy powder according to claim 1, having a spherical morphology.

* * * * *